United States Patent [19]

Rakov et al.

[11] Patent Number: 4,942,428

[45] Date of Patent: Jul. 17, 1990

[54] METHOD AND APPARATUS FOR ANNOTATING ELECTROPHOTOGRAPHIC PRINTS OF PHOTOGRAPHIC NEGATIVES

[75] Inventors: David M. Rakov; Joseph A. Manico, both of Rochester, N.Y.

[73] Assignee: Eastman Kodak Company, Rochester, N.Y.

[21] Appl. No.: 390,949

[22] Filed: Aug. 9, 1989

[51] Int. Cl.[5] ..... G03G 15/01

[52] U.S. Cl. ..... 355/202; 355/327; 355/39; 346/159

[58] Field of Search ..... 355/202, 244, 326–328, 355/38–41; 364/518, 525; 352/90; 346/159

[56] References Cited

U.S. PATENT DOCUMENTS

| | | | |
|---|---|---|---|
| 4,025,186 | 5/1977 | Hunt et al. | 355/14 |
| 4,099,860 | 7/1978 | Connin | 355/14 |
| 4,268,164 | 5/1981 | Yajima et al. | 355/41 |
| 4,294,536 | 10/1981 | Paxton | 355/14 |
| 4,551,008 | 11/1985 | Banton | 355/14 |
| 4,752,806 | 6/1988 | Haas et al. | 355/3 |
| 4,761,669 | 8/1988 | Langdon | 355/4 |
| 4,774,546 | 9/1988 | Corona et al. | 355/14 |

FOREIGN PATENT DOCUMENTS 59-170864 9/1984 Japan .

OTHER PUBLICATIONS

IBM Technical Disclosure Bulletin, vol. 22, No. 12, May 1980, pp. 5270–5271, Young, T., "Electrophotographic Printer with an Ion Writing Station Therein".

Gerald L. Pressman, Society for Information Display Digest, 1976, pp. 26–27, "Controlled Ion Flow Electrostatic Printing".

R. A. Fotland and J. J. Carrish, Proceedings of the First International Conference on Advances in Non-Impact Printing Technology, 1981, pp. 685–703, "Ion Projection Electrographic Printing".

Makoto Omodani, Yasushi Hoshino and Tomoaki Tanaka, J. of Physics D: Applied Physics, 18, pp. 153–161 (1985), "Ion Control Characteristics of a Pair of Operative Electrodes".

*Primary Examiner*—Joan H. Pendegrass

*Attorney, Agent, or Firm*—Raymond L. Owens

[57] ABSTRACT

Ion projection is used to annotate color images produced by an electrophotographic printer. The charge polarity, charge level and positions of the charge are selectively deposited on color separation images on a photoconductor.

6 Claims, 2 Drawing Sheets

METHOD AND APPARATUS FOR ANNOTATING ELECTROPHOTOGRAPHIC PRINTS OF PHOTOGRAPHIC NEGATIVES

BACKGROUND OF THE INVENTION

1. Field of the Invention

This invention relates to method and apparatus for annotating electrophotographic prints of photographic negatives using ion projection.

2. Background Art

When used here, the term annotation means any modification of the pictorial image, such as adding a title, frame numbers, or a decorative design; removing part of the image; changing the color or contrast of part of the image; or the like. Several ways have been proposed for annotating electrophotographic prints.

In U.S. Pat. No. 4,774,546, an annotation device includes an illumination source, an addressable light modulation device' and a lens array for forming the modulated light pattern n the photosensitive surface.

In U.S. Pat. No. 4,551,008, an apparatus uses flexible fingers with reflective surfaces to reflect light in order to discharge a photoconductor in a image-wise pattern.

In U.S. Pat. No. 4,752,806, a multi-mode document imaging system capable of copying a document includes an optical system to project light to add another image to the print.

These and other optical methods share the limitation that exposure to light from one of these devices can only reduce the charge on the photoconductor, it cannot increase the amount of charge. The annotation can therefore only be placed in a region in which the photoconductor is substantially undischarged by the exposure through the negative. This is usually accomplished by masking off the area in which the annotation is going to be placed during the exposure to the picture, which retains the charge in the corresponding area on the photoconductor. An optical system is then used to discharge the photoconductor in this region in a pattern that produces the desired annotation. This process results in a box that contains the annotation but is otherwise blank.

This disadvantage can be overcome by using an ion projection device to modify the electrostatic image rather than an optical system. The ion projection device deposits ions onto the photoconductor in an image-wise pattern and by choosing the polarity of the ions, it can either increase or decrease the charge in the image.

The use of an ion projection device to produce black and white annotations by an eletrophotographic printer is described in the *IBM Technical Disclosure Bulletin*, Vol. 22, No. 12, May 1980, pages 5270–5271.

In U.S. Pat. No. 4,761,669, there is shown an eletrophotographic printing machine in which a first image is recorded on a photoconductive member and developed with a liquid developer of a first color. Thereafter, the first electrostatic image is neutralized. An ion projection device records a second electrostatic image on the photoconductor, and the second image is developed with liquid developer of a second color to form a composite image. The composite image is then transferred to a receiver sheet.

None of these references disclose optical or ion projection means for annotation which choose the position, color, or density of the annotation in response to the content of the pictorial image.

In U.S. Pat No. 4,268,164, an electrophotographic apparatus copies and annotates documents. The apparatus includes a copy board on which the document to be copied is placed and slidable position indicating means along the edge of the copy board that can be adjusted to indicate where the annotation should be placed relative to the image of the document. This, however, is a manually operated apparatus in which an operator must position the indicating means. Also, the system requires that the first image end or be masked off in the region where the second image or annotation is to be placed. It does not provide for superimposing the annotation on the image of the document.

SUMMARY OF THE INVENTION

An object of this invention is to provide aesthetically pleasing annotated color photographic prints made using an electrophotographic process.

A further object is to select the position, color, and density of the annotation so as to produce an aesthetically pleasing print.

These objects are achieved by apparatus for annotating a color print of a photographic negative made by an electrophotographic printer having a photoconductor, comprising: (a) means for scanning a negative to acquire density information relating to density of different colors at positions within the negative; (b) means for projecting light through the negative onto the photoconductor to form color separation electrostatic images on the photoconductor; (c) ion projection means for selectively depositing charge on the color separation images to annotate the image; and (d) logic and control means for controlling the ion projection means to effect the annotation in accordance with density information measured by the scanning means.

According to the invention, annotation is accomplished by an ion projection device located between an exposure station and a toning station of an electrophotographic printer. The ion projection device can write directly over the electrostatic image of the picture being printed. By choosing the polarity of the ions, the charge in the image can be either increased r decreased, which determines whether the annotation is lighter or darker than the picture. By choosing the frame or frames of the separation on which to write, the color of the annotation can be controlled. Therefore, it is not necessary to mask off the portion of the image in which the annotation is to be placed, as is done with prior optical annotation systems, and the resulting annotation is written directly on the pictorial image instead of being in a contrasting box created by a mask.

According to this invention, information gathered by the scanner would be used automatically by the printer to choose the position, density, and color of the annotation to produce a pleasing result. For instance, to make a title easy to read, an area of the picture containing fairly uniform density and color would be chosen. The density and color of the annotation would be chosen to contrast with the background in the chosen area.

BRIEF DESCRIPTION OF THE INVENTION

The present invention is adapted to be used in electrophotographic apparatus such as that shown and described in commonly assigned U.S. Pat. No. 4,025,186 issued May 24, 1977. As disclosed therein, a photoconductive member is moved past a series of stations. At the start of the copy cycle, the photoconductive member receives an electrostatic charge at a charging station. A light image of a negative is then projected onto the charged photoconductive member at an exposure station to form a latent electrostatic image. The electrostatic image is developed with toner at a toning station. A receiver is brought into contact with the photoconductive member at a transfer station where the toner image is transferred to the receiver. The receiver carrying the unfused toner image is separated from the photoconductive member and passed through a fusing station comprised of two rollers which permanently fuse the toner to the receiver, forming a finished print.

Figure 1:
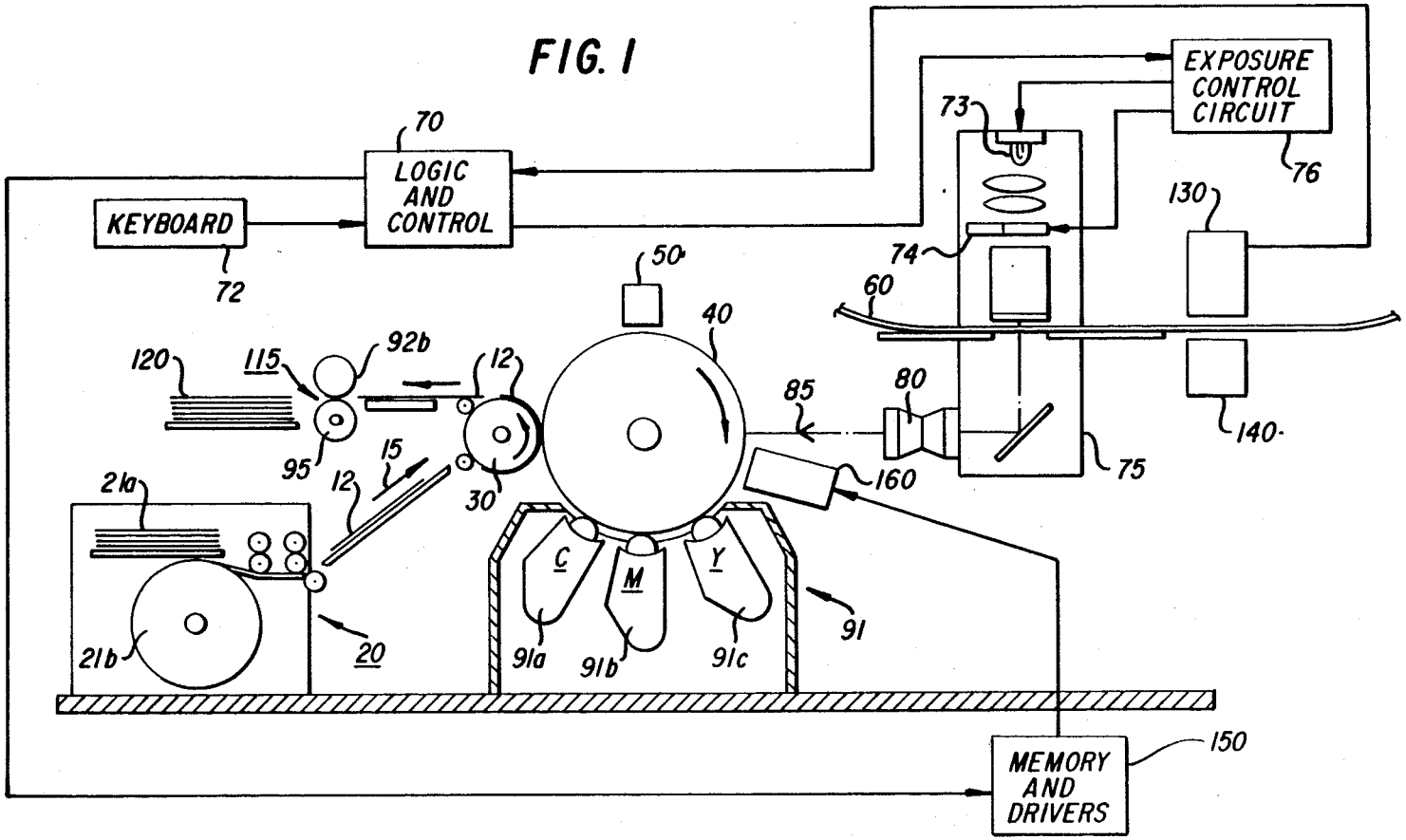
FIG. 1 is a schematic in accordance with the invention of an electrophotographic apparatus for producing prints of photographic negatives.

With reference to FIG. 1, the photoconductive member 40, shown as a rotatable drum, receives a substantially uniform electrostatic charge from the charging station 50. Cyan, magenta, and yellow color separation images of a frame of a photographic negative 60 are sequentially exposed by a flash lamp 73 in a housing 75. The colors are selected by rotating the filter wheel 74, which contains red, green, and blue filters. The flash lamp 73 and filter wheel 74 are actuated by exposure control circuit 76, which is controlled by logic and control unit 70. Logic and control systems for electrophotographic printers are well known in the art and include microprocessors. See for example U.S. Pat. Nos. 4,099,860 and 4,294,536.

Before reaching the lamp house 75, each negative frame passes a scanner 130. The negative is illuminated by the lamp 140 and the red, green, and blue color densities of the negative are measured as a function of position within the frame. The pattern of measurements forms a rectangular grid covering the negative frame. The color density data are sent to the logic and control unit 70 where they are processed. The logic and control unit 70 uses these data to determine the exposure conditions to use when printing that frame to produce the proper density and color balance. According to the present invention, the logic and control unit 70 also uses these data to determine any or all of the conditions for printing the annotation, such as the position, the density, the color, and the polarity of the annotation.

A colored light image of the negative 60 passes through a lens 80 and is directed in direction 85 onto the photoconductive member 40. Where the light strikes it, the photoconductive member 40 is discharged, forming an electrostatic image of the negative. After this exposure, the photoconductive member 40 rotates so that the image passes under an ion projection device 160. The ion projection device 160 deposits controlled amounts of charge in chosen positions on the photoconductive member 40, thereby annotating the previously created electrostatic image. Instructions specifying the annotation are provided by the operator to the logic and control unit 70 through a keyboard 72. The logic and control unit 70 uses the instructions from the operator in conjunction with the information from the scanner 130 to control the ion projection device 160. Data and control signals are sent from the logic and control unit 70 to a memory and drivers unit 150. The memory and drivers unit 150 contains a memory that stores the information to be written by the ion projection device 160 and drivers that vary the voltages on the control elements in the ion projection device 160, according to the information stored in the memory.

The photoconductive member 40 continues rotating so that the cyan, magenta, and yellow electrostatic latent images are sequentially developed with toner from toner station 91 comprised of cyan toner station **91*a*, magenta toner station 91*b*, and yellow toner station 91*c*. The developed colored toner images are then sequentially transferred to a receiver 12 brought into contact with the photoconductive member 40 at the transfer station 30. The receiver 12 carrying the three unfused toner images is separated from the photoconductive member 40 and passed through a fusing station 90** to complete the production of the print.

The scanner includes a light source 140 and a unit 130 containing three linear arrays of 24 photodiodes, each oriented perpendicular to the motion of the film, and electronics associated with the diode arrays. Filters are used so that each array measures the density of one of the primary colors: red, green, or blue. The electronics include logarithmic amplifiers that convert the currents from the photodiodes to voltages that represent densities. The voltages that represent the densities are sent to the logic and control unit 70.

As is well understood in the art, each array typically samples each negative frame 36 times as the negative is moved through the scanner. This produces a rectangular array of $24 \times 36 = 864$ density measurements for each color in each frame. When used to scan standard 35 mm film negatives, this produces measurements 1 mm apart.

There are many types of scanners that an be used in accordance with the invention. They include scanners with linear and two dimensional arrays of detectors; photodiode, phototransistor, and CCD detectors; scanners with spinning disks with holes through which the light is transmitted, thereby effecting the scanning function (Nipkow disk systems); scanners that are separate from the exposure station (as described in the example above); and scanners that are part of the exposure station.

Photographic printers employ scanners that can be used in this invention. Such scanners read color densities as a function of position in the negative before printing in order to provide information to the printer control system that automatically chooses the exposure and color balance conditions for printing. One example is the KODAK Minilab System 50 Printer/Paper Processor. It contains a 3 color CCD scanner system. Another example is the KODAK CLAS 35 Color Printer. It contains a high resolution color linear array scanner that reads 864 pixels per color in each negative frame.

The logic and control unit 70 includes a microcomputer that electronically controls the functioning of all the subsystems that make up the printer. It receives instructions from the operator through the keyboard 72. Part of the program that specifies the function of the logic and control unit 70 is the exposure determination algorithm. This algorithm uses the density information from the scanner to choose the printing conditions to produce the proper density and color balance in the print. This information is transmitted to the exposure control circuit 76, which controls the lamp 73 and the filters 74. There is also an algorithm that uses the same density information to choose the conditions for printing the annotation. This information is transmitted from the logic and control unit 70 to the memory and drivers unit 150.

The ion projection device 160 is disposed between the position where an image of the negative illuminates the photoconductor 40 and the development station 91. The ion projection device 160 has a source of ions and a control structure containing one or more apertures through which the ions flow to the photoconductor. Ions are generated in a region of high electric field. The high electric field is created by applying a high voltage to a small diameter wire, by applying a high voltage between small, closely spaced electrodes, or other means. If a DC voltage is used, generally ions of one polarity (positive or negative) are available for writing. The polarity of the ions available for imaging can be changed by changing the polarity of the applied high voltage. If an AC voltage is used to produce the ions, generally ions of both polarities are produced and are available for writing. The polarity of the ions extracted for writing is controlled by the voltages applied to the control electrodes.

Electrodes on the boundaries of the aperture or apertures control the flow of ions depending on the voltages applied t the electrodes. By changing the voltages applied to the electrodes at the appropriate times as the film moves past the ion projection device, a charge pattern corresponding to the desired annotation can be written on the film.

Figure 2:
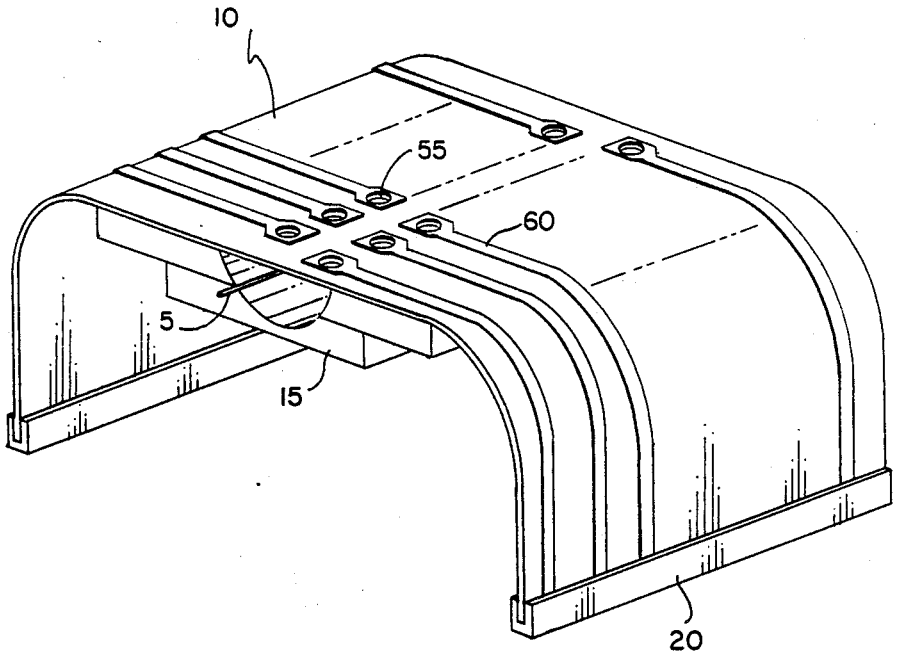
FIG. 2 is a pictorial of the ion projection device of FIG. 1, showing apertures and conductors that control the flow of ions.

FIG. 2 shows in detail one type of ion projection device 160 that can be used, having apertures 55 and electrical conductors 60 that control the flow of ions. FIG. 2 is not to scale for clarity of illustration. A high voltage wire 5 is used to generate corona ions. The ions flow out through the apertures 55 in a mask 10 and the conductors 60. The apparatus is as wide as the photoconductor drum, so that ions can be deposited on any portion of the drum as it rotates by addressing the proper apertures. Each hole is surrounded by a conductor 60 on the top surface of the mask 10. Each conductor 60 is connected to a driver circuit (not shown) by an edge connector 20, which connects with the driver circuits. The bottom surface (not shown) of the mask is covered with a conductor which is set at a fixed voltage. The flow of ions through the hole is controlled by varying the voltage applied on its conductor 60.

Ion projection devices and their operation are well known and described extensively by Gerald L. Pressman, *Society for Information Display Digest,* 1976, pp 26–27, R. A. Fotland and J. J. Carrish, *Proceedings of the First International Conference on Advances in Nonimpact Printing Technology,* 1981, pp 685–703, and Makoto Omodani, Yasushi Hoshino, and Tomoaki Tanaka, *J. of Physics D: Applied Physics,* 18, pp 153–161 (1985).

The following is an example of how the apparatus of FIG. 1 can be used to print rolls of photographic film brought in by customers. In the printer, the photoconductor is initially given a uniform charge of +400 volts by a corona charger. Light is projected through a negative onto the charged film to create an electrostatic image. After exposure, the voltage on the film can range from 0 to +400 volts. The annotation is written by an ion projection device that selectively deposits either positive or negative charge in an image-wise, controlled fashion When selected to deposit positive charge, the ion projection device deposits positive charge sufficient to charge the film from 0 volts up to 400 volts or from any voltage between 0 and 400 volts to any higher voltage between 0 and 400 volts. When selected to deposit negative charge, the ion projection device deposits negative charge sufficient to discharge the film from 400 volts to 0 volts or from any voltage between 0 and 400 volts to any lower voltage between 0 and 400 volts. Sine in this example the printer makes positive prints from negative images on the film, the printer is set up for a negative process. In this example, the toner is positively charged and a positive bias voltage of +400 volts is applied to the developer station. Places on the film that reach the development station still bearing the initial charge of +400 volts will not receive any toner, sine the film and the development station are at the same voltage. Places on the film with less than +400 volts will receive toner, with the amount of toner deposited increasing as the film voltage decreases.

Let us assume a roll of film containing negatives of pictures taken during a summer vacation is to be printed. The customer asks that the title "Colorado 1988" be printed near the bottom of each print. The title and the requested location are specified to the system through the keyboard 72. The first picture shows boats on a lake. There are several boats in the middle and far distance and one occupying the middle and left portions of the foreground. The right portion of the foreground (i.e. the right bottom of the picture) is smooth dark blue water. When the negative is scanned prior to exposure, the logic and control unit 70 determines that the lower middle and left portions of the picture contain varying densities and colors and that the lower right side of the picture is fairly uniform in density and color, that the area is dark, and that the color is blue. The logic and control unit 70 uses the information from the scanner 140 in combination with the information specified through the keyboard 72 to determine the exact location, color, and density for the title that will produce the most aesthetically pleasing result. Because the scanner 140 detected varying colors and densities in the lower middle and left parts of the picture, the system chooses not to put the title there, since that is a part of the picture that contains an object that the customer may not want covered by the title and because the varying color and density may make the title hard to read. The system chooses to put the title in the lower right portion of the picture, where the scanner 140 detected less variation in color and density. The color and density of the title are chosen to contrast with the dark blue in the picture. Many different choices are possible. The particular choice would be determined by the algorithm used to control the system. For instance, the algorithm could choose white letters, since that would look pleasing and be easily readable against a dark blue background. Since the printer uses a negative process, white letters would be written using charge of the same sign as the initial, uniform charge applied to the photoconductor. Because the title is to be white, the electrostatic image of the title must have a charge of at least +400 volts. The region where the title is being placed would be nearly fully discharged on the cyan and magenta separations because the image is dark blue, but the yellow separation would be nearly fully charged. Therefore, the ion projection device 160 would need to put down more charge on the cyan and magenta frames than the yellow frame to bring the written regions up to 400 volts. Another possibility would be to make the title red. This requires that the ion projection device write the text so as to discharge the magenta and yellow separations and fully charge the cyan separation. Therefore, the title would be written on the cyan frame using positive charge and the title would be written on the magenta and yellow frames with negative charge. A similar process would be followed for each subsequent negative frame to be printed.

Let us assume a situation where a customer asks for sequential frame numbers to be printed in the lower right hand corner of each picture. In this case, the position of the annotation is fixed, but the color and density of the annotation must be chosen by the system to contrast with the content of the picture in the chosen position.

Let us further assume the first frame is a picture of mountains with a dark shadow in the lower right hand corner. The scanner 140 detects that the picture is dark in the area to be annotated and the control system uses this information to decide that the number should be white. Because the picture is very dark, each of the three color separations is discharged close to 0 volts by the exposures through the negative. In order to be white in the print, the number must be represented by a charge of at least +400 volts on each frame of the separation. The ion projection device 160 therefore is instructed by the logic and control unit 70 to deposit positive charge and to write the number on each separation so that the resulting charge level is at least +400 volts.

The second frame has a large light grey rock in the lower right hand corner. The density measurements from the scanner tell the controller that the area to be annotated is low density in all three colors. The logic and control unit 70 uses this information to decide that the number should be black. Because the picture is light gray, each of the three color separations retains most of the original charge of +400 volts. In order for the number to be black in the print, it must be represented by a charge level close to 0 volts on each frame of the electrostatic image. The ion projection device therefore is instructed to deposit negative charge and to write the number on each frame so that the resulting charge level is near 0 volts.

A similar process is used for each of the subsequent negatives to be printed.

The invention has been described in detail with particular reference to a preferred embodiment thereof, but it will be understood that variations and modifications can be effected within the spirit and scope of the invention.

We claim:

1. Apparatus for annotating a color print of a photographic negative made by an electrophotographic printer having a photoconductor, comprising:

(a) means for scanning a negative to acquire density information relating to densities of different colors at positions within the negative;

(b) means responsive to such density information for projecting light through the negative onto the photoconductor to form color separation electrostatic images on the photoconductor;

(c) ion projection means for selectively depositing charge on the color separation electrostatic images to annotate the image; and (d) logic and control means for controlling the ion projection means to effect the annotation in accordance with density information measured by the scanning means.

2. The apparatus of claim 1 wherein the logic and control means causes the ion projection means automatically to control the ion charge polarity, deposited charge level, and annotation position.

3. The apparatus of claim 1 includes an operator-controlled keyboard, the logic and control means being coupled to the keyboard for controlling the ion projection means to vary the charge polarity, and charge level of the deposited charge.

4. The apparatus of claim 2 wherein said light projecting means includes a flash lamp and color filters and wherein a negative is illuminated by light from the flash lamp passing through the color filters.

5. Apparatus for annotating an electrostatic color print of a photographic negative, comprising:

(a) an electrophotographic printer having a photoconductor and a development station for developing electrostatic color images;

(b) means for scanning a negative to acquire densities of different colors at positions within the negative;

(c) means responsive to such density information for projecting light through the negative onto the photoconductor at an exposure position to form cyan, magenta, and yellow color separation electrostatic images on the photoconductor;

(d) ion projection means disposed between the exposure position and the development station for selectively depositing charge on some or all of the color separation images to annotate the image; and (e) logic and control means for controlling the ion projection means in accordance with the density information measured by the scanning means.

6. A method of annotating a print of a photographic negative comprising:

(a) scanning a negative to measure color densities at different positions on the negative., (b) projecting color separation images of the negative onto a photoconductor to form three color separation electrostatic images of the negative representing the cyan, magenta, and yellow separation images;

(c) using an ion projection device to modify at least some of the electrostatic images by depositing charge on the color separation images on the photoconductor; and (d) using the density and position information to control the ion projection device and to control charge polarity, charge level, and position of the charge deposition on the photoconductor to produce an annotation.

* * * * *